United States Patent [19]

Poling

[11] Patent Number: 4,794,827

[45] Date of Patent: Jan. 3, 1989

[54] DRAIN PLUG REMOVING DEVICE

[76] Inventor: Denzil C. Poling, Rte. 6, Box 80, Hagerstown, Md. 21740

[21] Appl. No.: 29,537

[22] Filed: Mar. 24, 1987

[51] Int. Cl.[4] ..... B25B 13/02

[52] U.S. Cl. ..... 81/125; 81/177.3

[58] Field of Search ..... 81/125 OR, 177.3, 124.7, 81/456, 454, 452; 269/254 R, 238, 254 CS; 24/498, 499, 500, 502, 507, 508, 510

[56] References Cited

U.S. PATENT DOCUMENTS

| | | | |
|---|---|---|---|
| 70,586 | 11/1867 | Grapple | 269/254 R |
| 1,188,305 | 6/1916 | Noerteman | 81/125 |
| 1,668,245 | 5/1928 | McGowan . | |
| 1,686,749 | 10/1928 | Higgins et al. . | |
| 2,498,324 | 2/1950 | Yourglich et al. | 81/125 |
| 2,746,330 | 5/1956 | Pfetzing . | |
| 3,039,159 | 6/1962 | Burke . | |
| 3,192,585 | 7/1965 | Montag . | |
| 3,967,697 | 7/1976 | Guenther . | |
| 4,098,398 | 7/1978 | Meyers . | |
| 4,101,000 | 7/1978 | Scully . | |
| 4,145,939 | 3/1979 | Garrison | 81/125 |
| 4,177,529 | 12/1979 | Sikula, Jr. . | |
| 4,219,062 | 8/1980 | Berkman . | |
| 4,230,002 | 10/1980 | Skidmore . | |
| 4,274,645 | 6/1981 | Ferguson . | |
| 4,283,032 | 8/1981 | Smith . | |
| 4,592,448 | 6/1986 | Morris . | |

*Primary Examiner*—Frederick R. Schmidt
*Assistant Examiner*—Lawrence Cruz
*Attorney, Agent, or Firm*—Bernard, Rothwell & Brown

[57] ABSTRACT

A drain plug removing device includes a rotatable socket for engaging and selectively holding a head of a drain plug. One end of a flexible line is connected to the rotatable socket, and the other end of the line is secured to a support to prevent the socket and drain plug from falling further than the length of the line if dropped and to support the line and the socket holding the drain plug. A method for removing a threaded drain plug from a collection pan includes the steps of engaging a rotatable socket with a head of a drain plug, the socket having a line connected thereto, securing an end of the line opposite the socket to a support, and rotating the socket to remove the drain plug.

7 Claims, 3 Drawing Sheets

DRAIN PLUG REMOVING DEVICE

BACKGROUND OF THE INVENTION

1. Field of the Invention

The present invention relates to the extraction of threaded drain plugs and the like from containers such as automotive crankcase pans for replacement of oil or other liquids present therein.

2. Description of the Background Art

Removing plugs used to retain oil in automotive-type crankcases and the like has remained essentially the same since the debut of the internal combustion engine. Typically, a catch basin or drainage funnel is placed below the drain plug and the drain plug is loosened with a tool. The drain plug then is removed by rotating the plug with the fingers. The oil usually spills onto the fingers upon removal of the drain plug, and many cause burns if it is hot. Often, the drain plug is dropped into the catch basin or drainage, requiring further contact with the dirty oil to locate the dropped plug.

There are numerous oil change devices proposed in the prior art, including expired U.S. Pat. No. 1,668,245 to McGowan disclosing a rotating crankcase drain funnel having a drain hose and a socket for removing the drain plug.

Expired U.S. Pat. No. 1,686,749 to Higgins et al. discloses an oil catch basin with a geared drain plug-removing wrench mounted thereon.

Expired U.S. Pat. No. 2,746,330 to Pfetzing discloses a unitary wrench and container for removing an oil filter including an oil-catching cup, a rotatable socket and a handle for rotating the socket.

U.S. Pat. No. 3,967,697 to Guenther discloses a crankcase oil drainage and collection device that requires a special drain plug having a passageway therein such that on partial removal of the plug, oil can drain from the crankcase into a funnel that directs the oil into an oil container.

U.S. Pat. No. 4,230,002 to Skidmore discloses a device for removing a plug and draining oil from a vehicle oil pan including a socket for removing the drain plug, a funnel for catching draining oil and an oil drain hose.

U.S. Pat. No. 4,592,448 to Morris discloses an oil pan drain receptacle including an oil-catching conduit for attachment to a crankcase by means of Velcro fasteners, a drain plug-removing wrench that is rotatable within the conduit, and a bag for collecting draining oil passing through the conduit.

Other devices for assisting replacement of motor oil in engines are disclosed in U.S. Pat. Nos. 4,098,398; 4,101,000 and 4,283,032. None of the above-described devices have enjoyed any significant degree of commercial success, primarily because of the time and expense in making use of them. All of the known devices have drawbacks, some requiring alteration of the plug to be removed or of the crankcase pan, others necessitating hand holding of a funnel while draining the oil.

Clip devices unrelated to oil plug removal are also known. U.S. Pat. No. 4,219,062 to Berkman discloses a magnetic fastener-holding tool attachment having a spring fingered device used to hold a screw.

Expired U.S. Pat. No. 3,039,159 to Burke discloses a clip for attaching to a high chair, the clip being connected by a string to a block for securing a spoon or the like in a loop.

Expired U.S. Pat. No. 3,192,585 to Montag discloses a combined hanger clip and clothes pin.

There remains a need in the art for a simple easy-to-use device to remove the plug from a crankcase pan while avoiding spillage onto the fingers and preventing the plug from falling into the drainage.

SUMMARY OF THE INVENTION

In accordance with the present invention, a drain plug removing device includes a rotatable socket for engaging and selectively holding the head of a threaded drain plug. One end of a flexible line is connected to the socket to permit engagement of the socket with the head of a drain plug and rotation of the socket when engaged with the head of a drain plug. Means are provided at another end of the line for selectively securing the line to a support member to prevent the socket and drain plug from falling further than the length of the line if dropped and to support the line and the socket holding the drain plug. The invention further provides a method for removing a threaded drain plug from a collection pan comprising the steps of engaging a rotatable socket with the head of a drain plug, the socket being capable of engaging and selectively holding the head of the drain plug, the socket being connected to one end of a flexible line to permit engagement of the socket with the head of the drain plug and rotation of the socket when engaged with the head of the drain plug. Another end of the line is secured to a support member. The socket then is rotated to remove the drain plug from the collection pan. The line secured to the support member prevents the socket and drain plug from falling further than the length of the line if dropped, and supports the socket holding the drain plug.

DETAILED DESCRIPTION OF THE PREFERRED EMBODIMENTS

Figure 1:
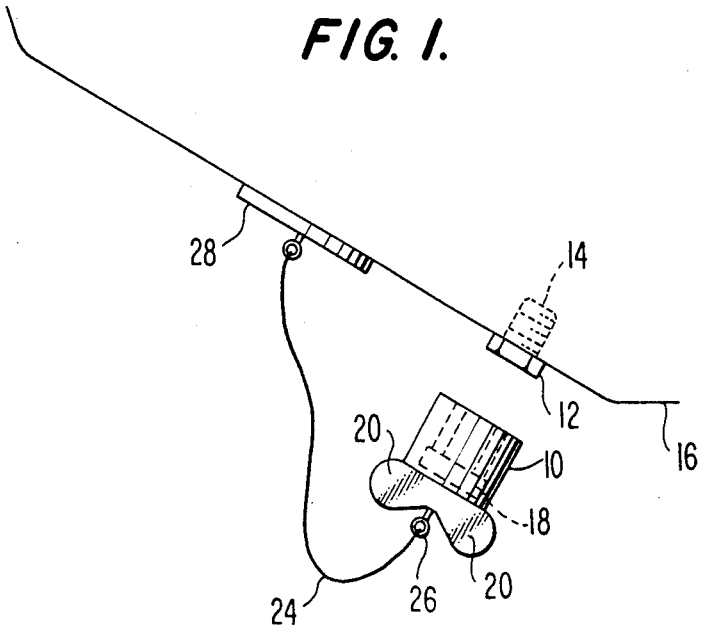
FIG. 1 is a side elevation view, partly schematic, showing a drain plug removing device according to one embodiment of the invention in use.
Figure 2:
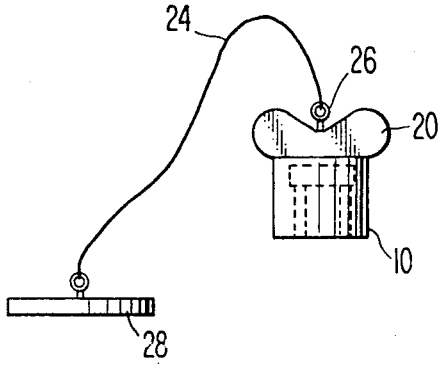
FIG. 2 is a side elevation view, partly schematic, of the drain plug removing device shown in FIG. 1.
Figure 3:
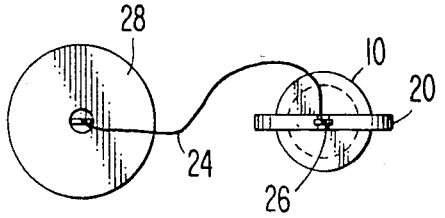
FIG. 3 is a top elevation view, partly schematic, of the drain plug removing device shown in FIG. 1.

In the embodiment shown in FIGS. 1–3, a drain plug removing device includes a rotatable socket 10 for engaging a head 12 of a threaded drain plug 14. Drain plug 14 permits drainage and replacement of oil from an automotive crankcase oil pan 16 or the like.

Prior to engagement of the rotatable socket 10 with the head 12 of drain plug 14, the drain plug is loosened utilizing a socket wrench or other suitable tool. In the embodiment shown in FIGS. 1–3, socket 10 is manufactured of a plastic material, and is complementary to and mates with plug head 12. A magnet 18 is fixed within socket 10 to hold drain plug 14 after it is removed. A pair of winglets 20 are provided on socket 10 to allow rotation of the socket and the drain plug 14 with a fingertip, thereby avoiding contact with both the plug 14 and escaping oil.

Figure 4:
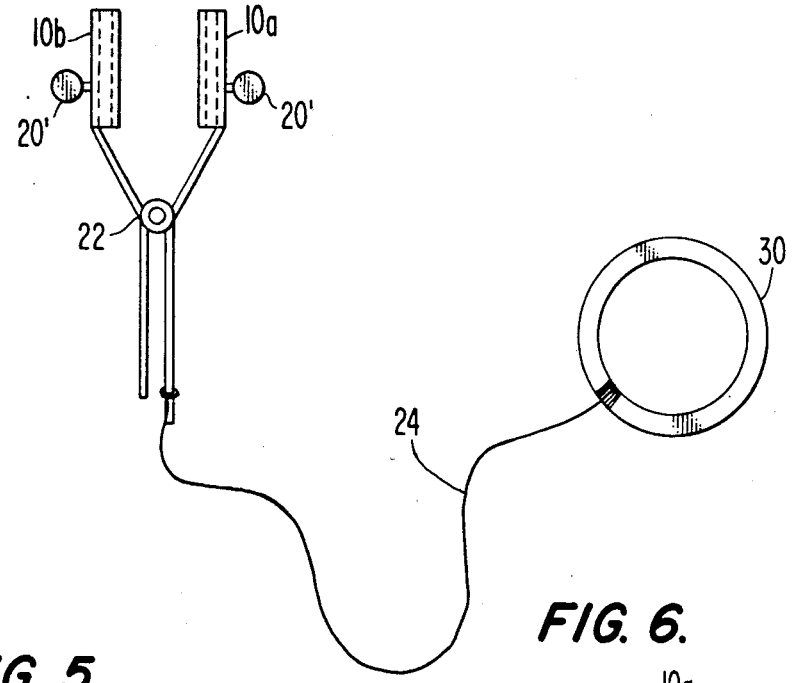
FIG. 4 is a side elevation view, partly schematic, of a drain plug removing device according to a second embodiment of the invention having an openable plug socket in an open position.
Figure 5:
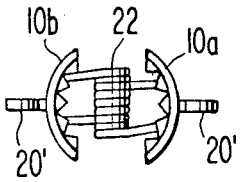
FIG. 5 is a top elevational view of the openable socket shown in FIG. 4 in the open position.
Figure 6:
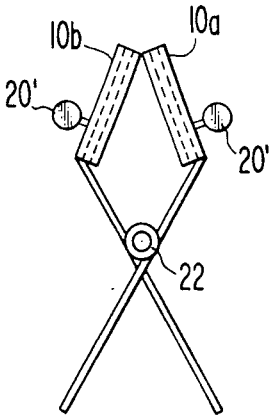
FIG. 6 is a side elevation view of the openable socket shown in FIG. 4 in a closed position.

In the embodiment shown in FIGS. 4–6, the rotatable socket includes a pair of openable jaws **10*a* and 10*b* that are urged towards each other by a spring 22 in a manner similar to that of a clothes pin. In this embodiment, winglets 20'** are provided for rotation of the socket with a fingertip to thereby avoid contact with both the plug and escaping oil.

Figure 7:
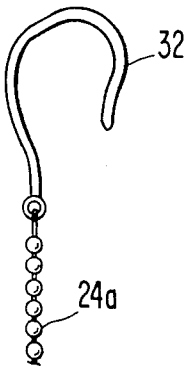
FIG. 7 is a side elevation view of a securing hook with chain line for securing a plug engaged by a socket according to yet another embodiment of the invention.

Referring back to FIGS. 1–3, one end of a flexible line 24 is connected to socket 10 by a swivel 26 to permit rotation of the socket when engaged with the head 12 of plug 14. Line 24 can be of any suitable flexible material. Examples of suitable line include a chain-link line of any suitable configuration, such as chain **24*a* shown in FIG. 7, or, a twisted fiber or metal cord line, such as line 24*b*** shown in FIG. 8. A ball and post chain, as shown in FIG. 7, such as is commonly found in light switches and key chains, is self-swiveling and does not require a separate swivel such as is shown in FIG. 1.

Means for selectively securing line 24 to a support member are provided at an opposite end of line 24 from socket 10. In the embodiment shown in FIGS. 1–3, this securing means is comprised of a magnet 28 connected to line 24. Magnet 28 will selectively secure line 24 to an iron or steel support member, such as crankcase pan 16 shown in FIG. 1. The socket 10 holding drain plug 14 is thereby prevented from falling further than the length of line 24 if dropped after the drain plug is removed from the pan.

Figure 8:
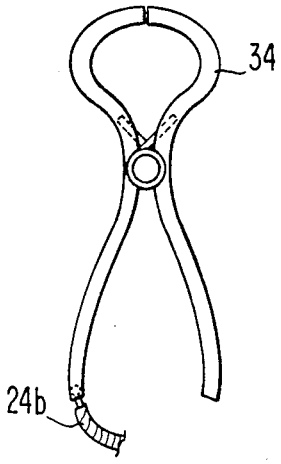
FIG. 8 is a side elevation view of a securing clamp with twisted cord line for securing a plug engaged by a socket according to still another embodiment of the invention.

Other suitable means can be utilized for selectively securing line 24 to a support member. For example, in the embodiment shown in FIG. 4, the securing means is comprised of a ring or loop 30 connected to line 24, that can be engaged with any suitable support member located near the drain plug. Conveniently, ring 30 can be engaged over a finger of the hand of the person removing the drain plug, the finger thereby acting as the support member. Other suitable securing means include a hook 32 as shown in FIG. 7 or a spring-biased clamp 34 as shown in FIG. 8.

Figure 9:
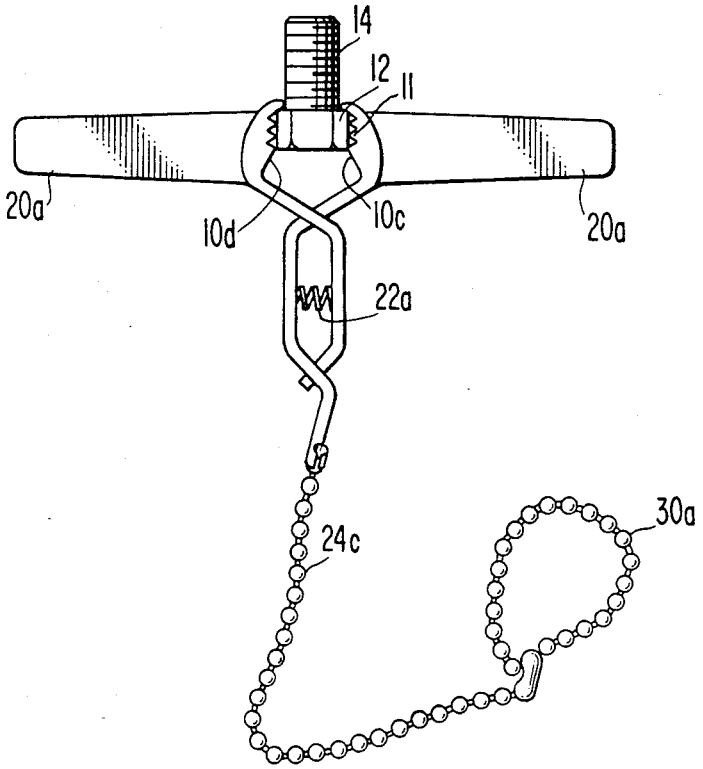
FIG. 9 is a side elevation view of a drain plug removing device according to a third embodiment of the invention having an openable plug socket.

FIG. 9 shows another embodiment of the invention wherein the rotatable socket is comprised of a pair of openable jaws **10*c* and 10*d* that are urged towards each other by a spring 22*a*. Jaws 10*c* and 10*d* include plug head-gripping teeth 11 that grip the sides of the head 12 of bolt 14, as well as grip underneath the head 12 of bolt 14 after the bolt has been slightly loosened using a conventional wrench. According to this embodiment, winglets 20*a* are provided for rotation of the clip-like socket, and a chain-line 24*c* and loop 30*a*** are provided for securing the socket.

Figure 10:
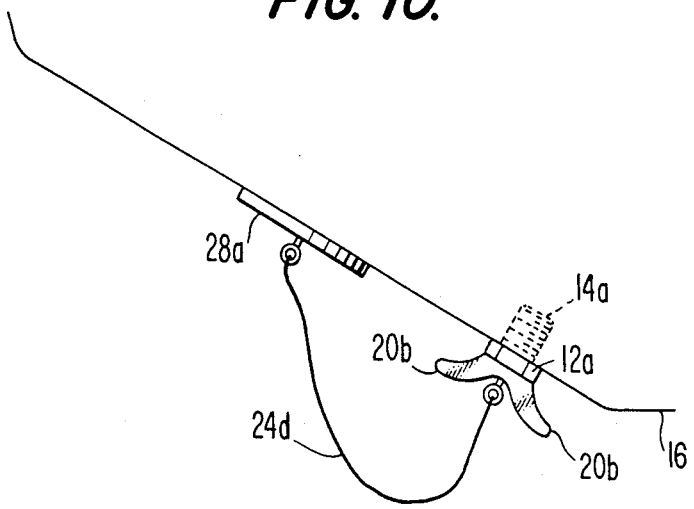
FIG. 10 is a side elevation view, partly schematic, of a removable drain plug according to one embodiment of the invention.

FIG. 10 illustrates yet another embodiment wherein winglets **20*b* are permanently attached to the head 12*a* of a drain plug 14*a* to allow rotation of drain plug 14*a* with a fingertip after loosening the drain plug with a conventional wrench. A line 24*d* is connected at one end to the drain plug by a swivel, and at another end to a magnet 28*a*** or any suitable securing means such as a hook or a loop, or permanently affixed to a portion of the automobile.

The method of the invention will be described with reference to FIG. 1. Initially, a conventional wrench (not shown) is used to loosen plug 14 before socket 10 is engaged with the head 12 of plug 14. Thereafter, or alternatively prior thereto, magnet 28 is placed against crankcase pan 16 to secure the line and the socket to the crankcase pan. Socket 10 is then rotated by twirling winglets 20 with a fingertip to remove the drain plug and thereby avoid contacting both plug 14 and oil escaping from crankcase pan 16. As the plug finally exits the crankcase pan opening, socket 10 with drain plug 14 held therein by magnet 18 can be allowed to drop and be caught by line 24 attached to the securing magnet 28, which itself is secured to the supporting member that in this embodiment is the crankcase pan 16.

The present invention provides a simple and easy-to-utilize method and device for removing a plug from a crankcase pan while eliminating spillage onto the fingers and preventing the plug from falling into drainage such as a catch basin or funnel beneath the pan.

Since many modifications, variations and changes in detail can be made to the described embodiments, it is intended that all matter in the foregoing description and shown in the accompanying drawings be interpreted as illustrative and not in a limiting sense.

What is claimed is:

1. A drain plug removing device comprising:

(a) a rotatable socket comprised of openable jaws each having a separate jaw arm associated therewith with a separate spring means between the jaw arms for urging the jaws together for engaging and selectively holding a head of a threaded drain plug, the jaw arms being engageable by a user's fingers to bias the jaws into and out of engagement with said head, said jaws including means for extending underneath the head of at least a partially loosened drain plug to grip said head and prevent said head from disengaging with said jaws when the jaws are urged together, the socket including a plurality of winglets extending outwardly of said jaws for rotating the socket and the drain plug by twirling with a user's finger;

(b) a flexible line attached at a first end thereof to the socket to permit engagement of the socket with the head of a drain plug and rotation of the socket when engaged with the head of a plug; and (c) the other end of said line including means for selectively securing the line to a user's finger to prevent the socket and drain plug from falling further than the length of the line if dropped and to support the line and the socket holding the drain plug.

2. The device of claim 1 further including a swivel connecting said line to said socket.

3. The device of claim 1 wherein said line is a twisted fiber or metal cord line.

4. The device of claim 1 wherein said line is a chain link line.

5. The device of claim 1 wherein the means for extending underneath the head of at least a partially loosened drain plug is comprised of a plurality of teeth extending from said jaws.

6. The device of claim 1 wherein said plurality winglets is comprised is a pair of opposed winglets extending outwardly of said jaws.

7. The device of claim 1 wherein the securing means is a loop.

* * * * *

UNITED STATES PATENT AND TRADEMARK OFFICE

CERTIFICATE OF CORRECTION

PATENT NO. : 4,794,827

DATED : January 3, 1989

INVENTOR(S) : Denzil C. Poling

It is certified that error appears in the above-identified patent and that said Letters Patent is hereby corrected as shown below:

Front Page, [56], delete "Grapple" and substitute therefor -- Mansur --;

Column 1, line 19, delete "many" and substitute therefor -- may --;

Column 5, line 7, after "plurality" insert therefor -- of --.

Signed and Sealed this

Twentieth Day of November, 1990

*Attest:*

*Attesting Officer*

HARRY F. MANBECK, JR.

*Commissioner of Patents and Trademarks*